US005358418A

United States Patent [19]

Carmichael

[11] Patent Number: 5,358,418

[45] Date of Patent: Oct. 25, 1994

[54] WIRELINE WET CONNECT

[76] Inventor: Alan L. Carmichael, 24002 Farmhill, Spring, Tex. 77373

[21] Appl. No.: 38,243

[22] Filed: Mar. 29, 1993

[51] Int. Cl.[5] ..... E21B 23/00

[52] U.S. Cl. ..... 439/190; 166/65.1; 439/271; 439/700

[58] Field of Search ..... 439/190–194, 439/271–277, 700, 824; 166/65.1; 277/123

[56] References Cited

U.S. PATENT DOCUMENTS

| | | | |
|---|---|---|---|
| 4,105,279 | 8/1978 | Glotin | 439/700 |
| 4,553,807 | 11/1985 | Cane | 439/190 |
| 4,588,243 | 5/1986 | Ramsay | 166/65.1 |
| 4,690,212 | 9/1987 | Termohlen | 439/191 |
| 5,131,464 | 7/1992 | Lenhart | 439/190 |

*Primary Examiner*—Neil Abrams

*Attorney, Agent, or Firm*—Kenneth A. Keeling

[57] ABSTRACT

A wireline wet connect is disclosed for releasable connection of an electrical contact and receptacle in a well drill string, the wet connect including co-axial connecting male and female connecting assemblies. The male connecting assembly 13 includes a cylindrical body 16, a central conductor rod 18, an electrical contact 24, and an insulating sleeve 20. The female connecting assembly 14 includes a cylindrical outer body 26, an insulating sleeve 28 a retainer sleeve 96, an electrical receptacle 36, and a conductor 32 A spring 34 is provided between the receptacle and the electrical conductor, the spring biasing the receptacle toward the conductor rod contact. Concentric ring seals 110,114 insulate the electrical contact 24 and receptacle 36 from fluids exterior of the said seals 110,114.

3 Claims, 1 Drawing Sheet

WIRELINE WET CONNECT

FIELD OF THE INVENTION

This invention relates generally to the field of electrical conductors utilized in oil and gas wells and more particularly to electrical connectors for releasably connecting electrical conductors downhole, such electrical connectors being commonly referred to as wireline wet connects.

BACKGROUND OF THE INVENTION

Electrical conductors are used in directional drilling of wells and in well logging systems to convey electrical signals to and from downhole tools. In directional and/or horizontal well drilling, an electrical conductor or wireline is connected between the steering tool and well surface equipment, the wireline extending through the interior of the drill string. The wireline transmits electrical signals to and from the downhole tools connected therewith.

It is desirable or necessary from time to time to connect, disconnect and/or reconnect the downhole wireline. It may be necessary to connect, disconnect, and/or reconnect logging instruments. It may be necessary to disconnect downhole wireline to allow drill string rotation and to reconnect same. Disconnecting and reconnecting are required incident to inserting additional drill pipe or removing drill pipe from the drilling string.

Insulation of the electrical contact and receptacle from the drilling string fluids is necessary due to the conductivity of brine or brackish fluids associated with drilling operations. If not adequately sealed, the electrically conductive brackish liquid interferes with the transmission of electrical signals between the surface and the downhole tool and accelerates corrosion.

Disadvantages of the prior art include failure to effectively seal electrically-conductive brine away from the receptacle-contact interface. Another disadvantage of the prior art is failure to effectively seal the conductor from other metal surfaces of the wet connect seal, resultive in infiltration of brine between the conductor and the wet connect body thereby allowing electrical conduction between the conductor and the wet connect body. Current technology requires insertion of a quantity of grease to protect electrical connections to the extent possible from brackish liquids.

Ramsey et al. U.S. Pat. No. 4,588,243 discloses a make and break mechanical and electrical latch subassembly providing for connection of a wireline. The assembly includes a male probe and a female receiver, the female receiver including a pair of spaced rings extending from the female receiver, the spaced rings first receiving the male probe and orienting the male probe toward the smaller orifice provided in the receiver. The male probe includes inclined shoulders to align the smaller forward extension of the male probe with the smaller orifice provided in the female receiver.

Lenhart et al. U.S. Pat. No. 5,131,464 discloses a connectable and releasable electrical wet connect for transmitting electrical signals including telescoping male and female electrical connectors. The male member includes a support shoulder for supporting the wet connect in the drill string, a passageway for flow of fluids through the drill string, an electrical contact extending through the male member, a tapered and insulating seal positioned below the electrical contact, and a tapered and insulating female seal positioned below the electrical contact for co-acting with the male seal for insulating the engaged receptacle and contact from fluid in the drill string.

It is an object of the present invention to provide an improved wireline wet connect for use in brackish environments.

It is an object of the present invention to provide a wireline wet connect providing for improved electrical insulation between the electrical contact-receptacle interface and the surrounding environment.

It is an object of the present invention to provide a wireline wet connect having an improved connection between the electrical receptacle and the electrical contact.

It is an object of the present invention to provide a wireline wet connect having improved insulation characteristics and capable of telescopic self-alignment.

The foregoing and other objects of the present invention are accomplished by a wireline wet connect for releasable connection of an electrical contact and receptacle in a well drill string, the wet connect including co-axial connecting male and female connecting assemblies. The male connecting assembly includes a central upwardly-extending conductor rod having an electrical contact at its upward end, the contact being received in a receptacle provided in the female connecting assembly. The conductor rod is contained with and surrounded by an insulating sleeve. The conductor rod and insulating sleeve are contained along a portion of their length within a cylindrical body. The cylindrical body includes inclined shoulders for supportably receiving an external retainer sleeve provided on the female connecting assembly. A three-finned landing member is provided exterior of the cylindrical body of the male connecting assembly for supporting the wet connect on a drill string collar. A lower connector sleeve is releasably engaged with the cylindrical body, the lower connector sleeve engaging a wireline rope socket. The female connecting assembly comprises a cylindrical outer body surrounding an insulating sleeve, the insulating sleeve releasably contained within the outer body by a retainer sleeve, the retainer sleeve having a lower inclined collar receivable on a shoulder of the cylindrical body. An electrical receptacle and a conductor are contained interior of the insulating sleeve. A spring is provided between the receptacle and the electrical conductor, the spring biasing the receptacle toward the conductor rod contact. Concentric ring seals are provided inwardly of the insulating sleeve, the said seals engaging the conductor rod insulating sleeve below the contact and providing electrical insulation between the electrical contact and receptacle and fluids exterior of the said seals. The seals are constructed so as to provide an outer sealing ring for sealing contact with the insulating sleeve, an inner sealing ring for sealing contact with the conductor rod insulating sleeve, and a flexible connection between the outer sealing ring and the inner sealing ring. Upon connection of the male connecting assembly with the female connecting assembly, electrical connection of the conductors is established, the electrically conductive brine being sealed within insulated annular voids and sealed external of the said conductors, receptacle and contact.

DESCRIPTION OF THE PREFERRED EMBODIMENT

Figure 1:
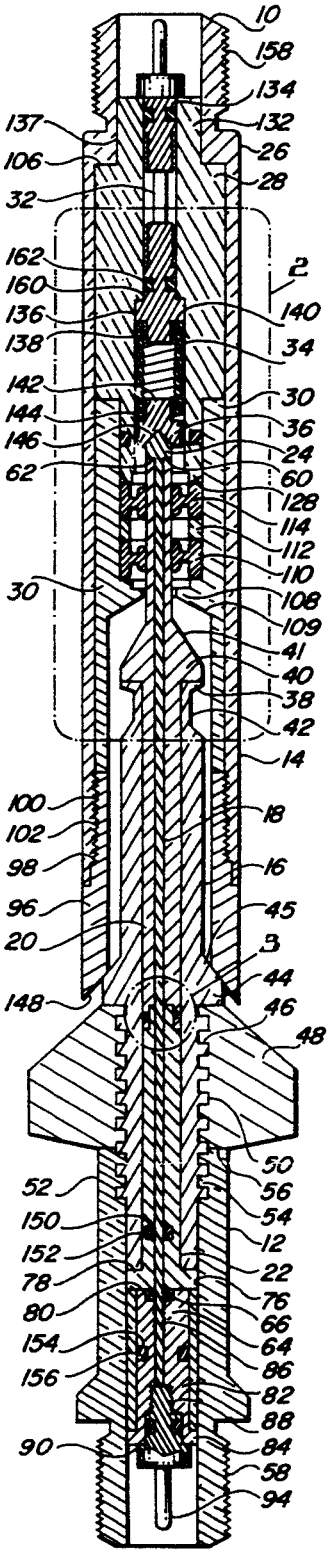
FIG. 1 illustrates a cross-sectional view of the wireline wet connect of the present invention with the lower male assembly and upper female assembly engaged.
Figure 4:
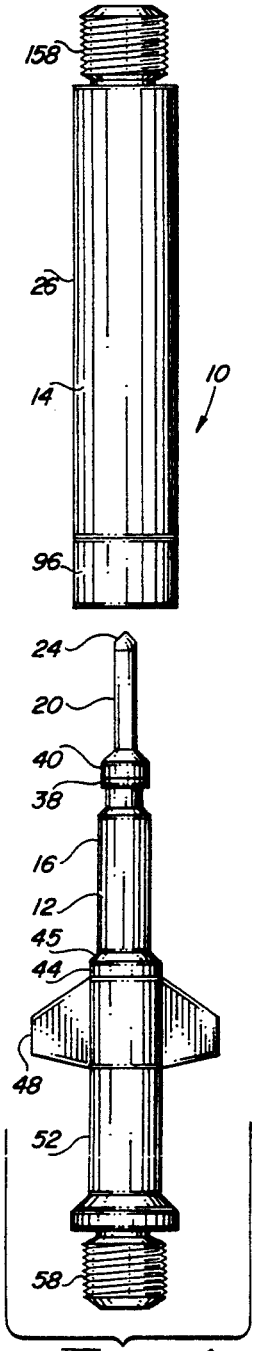
FIG. 4 depicts a view of the wireline wet connect of the present invention with the male assembly and female assembly disengaged.

Referring to FIGS. 1 and 4, the wireline wet connect 10 of the present invention is depicted. The wireline wet connect 10 comprises a lower male connecting assembly 12 and an upper female connecting assembly 14.

Male connecting assembly 12 includes a hollow, generally cylindrical body 16 having a conductor rod 18 extending therethrough and upwardly therefrom. The conductor rod 18 is centered in the cylindrical body 16 and segregated and insulated from the cylindrical body 16 by upper insulating sleeve 20 and lower insulating sleeve 22.

Still referring to FIGS. 1 and 4, the female connecting assembly 14 comprises a hollow, generally cylindrical outer shell 26 containing generally cylindrical upper insulating sleeve 28 and lower insulating sleeve 30. Conductor 32 is contained within upper insulating sleeve 28 and is mechanically and electrically connected by means of cylindrical spring 34 to electrical receptacle 36.

Upon engagement of female connecting assembly 14 with male connecting assembly 12, cylindrical spring 34 biases receptacle 36 against contact 24 to provide electrical connection between conductor 32 and conductor rod 18.

An important aspect of the present invention, to be discussed in more detail subsequently herein, is the sealing of the receptacle 36 and contact 24 interface provided by concentric ring seal 110 and concentric ring seal 114, said concentric ring seals 110 and 114 sealing brine within the insulating sleeve 28 annulus from brine exterior of the insulating sleeve 28 annulus.

Referring to FIG. 1, the details of construction of the male connecting assembly 12 are depicted. Cylindrical body 16 is constructed of a rigid material, such as stainless steel.

Cylindrical body 16 is provided with an upper flange 38 at its upper terminus which upper flange 38 receives an outwardly extending shoulder 40 of upper insulating sleeve 20. Cylindrical body 16 is provided with a fishing neck 42 near its upper end. Fishing neck 42 comprises a reduced external diameter section of cylindrical body 16 to facilitate retrieval of male connector assembly 12 from a downhole location pursuant to methods known to practitioners of the art.

Cylindrical body 16 is provided with a flange 44 near the medial portion of the body, said flange 44 having an inclined upper surface 45, the upper surface 45 being inclined outwardly and downwardly. External threading 46 is provided exterior of cylindrical body 16 below flange 44. A three-finned landing member 48 is provided externally of cylindrical body 16. The three-finned landing member 48 is provided with internal threading 50 for releasable connection of the landing member 48 to the external threading 46 of the cylindrical body 16. The three-finned landing member 48 supports the male connector assembly 12 on a co-acting shoulder (not shown) in a drilling string sub-assembly (not shown). Landing members such as landing member 48 are commonly used in the industry, their function and use being well known to persons skilled in the art.

Still referring to FIG. 1, wire rope connector sleeve 52 comprises a generally cylindrical member constructed of a rigid material such as stainless steel. Wire rope connector sleeve 52 is provided with internal threading 54 for releasable connection to the external threading 46 of cylindrical body 16.

Wire rope connector sleeve 52 abuts the three-finned landing member 48 at its upper terminus 56. Wire rope connector sleeve 52 is provided with external threading 58 at its lower end, such external threading 58 being provided for connection to a wireline rope connector (not shown). Cylindrical body 16 and connector sleeve 52 together provide a rigid body connected to the downwardly-extending wireline (not shown) within the drill string, the male connector assembly 12 being supported by the three-finned landing member 48 on a shoulder provided within the interior of a drill string sub-assembly, the male connector assembly 12 thereby supporting the wireline.

Still referring to FIG. 1, conductor rod 18 is located centrally of cylindrical body 16 and wire rope connector sleeve 52. Conductor rod 18 is an electrical conductor constructed in the preferred embodiment of beryllium copper. Contact 24, comprising a generally conical member is provided at the upper end of conductor rod 18. Contact 24 has an outwardly-extending lower surface 60 abutting end surface 62 of upper insulating sleeve 20.

Conductor rod 18 is provided with external threading 64 near its lower, distal end, such external threading 64 receiving nut 66.

Conductor rod 18 is insulated from cylindrical body 16 by upper insulating sleeve 20 and lower insulating sleeve 22. Upper insulating sleeve 20 comprises a generally cylindrical, electrically-insulating member sized in relation to conductor rod 18 and the interior surface of cylindrical body 16 so as to tightly fit in the annular space between conductor rod 18 and cylindrical body 16.

Upper insulating sleeve 20 is provided with radially-extending projection 40, the lower surface of extending projection 40 engaging flange 38 of cylindrical body 16. Outwardly-extending projection 40 is provided with an inclined upper shoulder 41.

Figure 3:
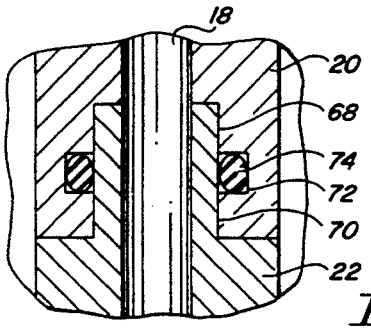
FIG. 3 depicts a detailed view of a section of FIG. 1.

Insulating sleeve 20 is abutted at its lower end by lower insulating sleeve 22. Referring to FIG. 3, an annular opening 68 is provided in upper insulating sleeve 20 at its lower end, such annular opening 68 receiving a reduced-diameter extension 70 extending upwardly from lower insulating sleeve 22. A ring seal gland 72 is provided internally of upper insulating sleeve 20 at the annular opening 68, such ring seal gland containing ring seal 74. Annular opening 68, reduced diameter extension 70, ring seal gland 72 and ring seal 74 co-act to seal the connection of upper insulating sleeve 20 and lower insulating sleeve 22.

Referring to FIG. 1, lower insulating sleeve 22 is provided with an expanded diameter section 76 at its lower end, said section 76 including shoulder 78 abutting the lower end of cylindrical body 16, the external diameter of expanded diameter section 76 being so sized as to fit within wire rope connector sleeve 52. Section 76 additionally contains an expanded interior cavity defining interior transverse surface 80. Conductor rod 18, upper sleeve 20 and lower sleeve 22 are so sized in relation to each other that nut 66 may be tightened against interior surface 80 to tightly retain lower insulating sleeve 22 and upper insulating sleeve 20 between contact 24 and nut 66, the upper insulating sleeve 20 and lower insulating sleeve 22 being compressed between the said nut 66 and contact 24.

Ring seal gland 150 is provided interior of lower insulating sleeve 22 above expanded diameter section 76. Ring seal 152 is provided interior of ring seal gland 150. Ring seal 152 is compressed between ring seal gland 150 and conductor rod 18 providing a seal to prevent brine infiltration or out flow.

Still referring to FIG. 1, lower insulating adaptor 82 comprises a hollow cylindrical member having an outwardly extending lower lip 84. Lower insulating adaptor 82 is closely contained within the expanded diameter section 76 of lower insulating sleeve 22, lip 84 abutting the lower end of said section 76. Interior threading 86 is provided at the upper end of adaptor 82, said threading so sized as to fit threading 64 of conductor rod 18.

Ring seal gland 154 is provided in the exterior surface of adaptor 82 with ring seal 156 provided therein. Ring seal gland 154 and ring seal 156 co-act with the interior surface of expanded diameter section 76 to seal the external surface of adaptor 82 and the annulus of expanded diameter section 76 from brine infiltration or outflow.

Threading 88 is provided near the lower end of adaptor 82 to threadably receive electrical connector 90, electrical connector 90 being a commercially available electrically conductive connector which connector is known to practitioners of the art particularly for the connection of wirelines with steering tools.

The electrical connector 90 is provided with an extension 94 for engagement with a co-acting conductor receptacle (not shown) provided in the downwardly extending wireline. The external threading 58 provided on connector sleeve 52 is constructed to fit standard wireline rope sockets.

Referring to FIG. 1, female connector assembly 14 includes a hollow cylindrical outer shell 26, said outer shell 26 being provided with external threading 158 at its upper end, said external threading 158 being so sized as to connect with standard wireline rope sockets. Outer shell 26 is preferably constructed of a rigid material such as stainless steel.

A retainer sleeve 96 is provided at the lower end of outer shell 26. Retainer sleeve 96 comprises a rigid, hollow, cylindrical member preferably constructed of a material such as stainless steel. The external diameter of retainer sleeve 96 is equivalent to the external diameter of shell 26. Retainer sleeve 96 includes a reduced-diameter upper end 98 provided for mating with the interior surface of shell 26.

Upper end 98 of retainer sleeve 96 is so sized to be received within the interior diameter of outer shell 26. External threading 100 is provided on upper end 98 co-acting with internal threading 102 provided interior of outer shell 26 to threadably connect retainer sleeve 96 with outer shell 26.

An inclined lower surface 148 is provided at the lower end of retainer sleeve 96 said inclined lower surface 148 being inclined at an angle generally equivalent to the angle of inclination of upper surface 45 of flange 44 of cylindrical body 16.

Figure 2:
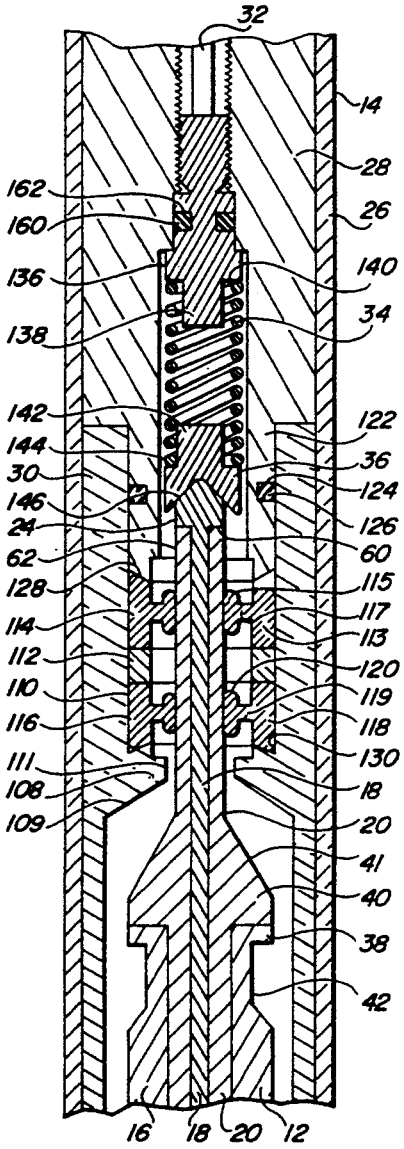
FIG. 2 depicts a detailed view of a section of FIG. 1.

Referring to FIGS. 1 and 2, female lower insulating cylinder 30 comprises a hollow cylindrical member having varying internal diameters defining various shaped annular spaces. Lower insulating cylinder 30 is constructed of an electrically-insulating material. The lower edge of female lower insulating cylinder 30 abuts the upper edge of reduced diameter upper end 98.

Upper insulating barrel 28 comprises a hollow cylindrical member constructed of an electrically-insulating material. The lower end of insulating barrel 28 abuts the upper end of lower insulating cylinder 30. Lower insulating cylinder 30 and upper insulating barrel 28 are contained within outer shell 26 by retainer sleeve 96 at the lower end and inwardly extending surface 106 of outer shell 26 provided near the upper end of outer shell 26.

At its lower end, the interior diameter of lower insulating cylinder 30 is generally coincident with the interior diameter of retainer sleeve 96. Referring to FIG. 2, an inward-extending projection 108 is provided in lower cylinder 30. Projection 108 defines a reduced internal diameter section 111 of lower cylinder 30. Projection 108 has inclined lower surface 109. The reduced diameter section 111 is larger than the external diameter of the projecting upper insulating sleeve 20 and the contact 24 of male connector assembly 12, contact 24 and upper insulating sleeve 20 readily extending through the said reduced diameter section 111. Inclined lower surface 109 facilitates extension of contact 24 through section 111.

An expanded internal diameter section 116 is provided in lower cylinder 30 above projection 108, said expanded interior diameter section 116 receiving first concentric ring seal 110, a spacer 112 provided above said first concentric ring seal 110 and a second concentric ring seal 114 provided above spacer 112. Spacer 112 comprises a hollow cylindrical member fitting within the section 116 of lower insulating cylinder 30.

Concentric ring seal 110 comprises an outer ring seal 118 and a concentric inner ring seal 120 connected by a reduced-area connecting extension 119. Concentric ring seal 110 is constructed of an electrically-insulating flexible material such as viton compound.

Outer ring seal 118 of concentric ring seal 110 is more rigid than the reduced-area extension 119 due to larger mass. The inner ring seal 120 of sealing ring 110 extends inwardly of outer ring seal 118. The internal diameter of inner ring seal 120 is slightly less than the external diameter of the corresponding section of upper insulating sleeve 20. The flexible material of which concentric ring seal 110 is constructed allows contact 24 and upper insulating sleeve 20 to pass therethrough, said reduced area extension 119 bending to accommodate such movement.

In like manner, concentric ring seal 114 comprises outer seal 113 and inner ring seal 115 with a reduced area extension 117 connecting ring seal 113 with ring seal 115. Contact 24 and upper insulating sleeve 20 may likewise extend through inner ring seal 115.

Still referring to FIG. 2, upper insulating barrel 28 is provided with a reduced external diameter extension 122 such reduced diameter extension 122 being sized to slidably fit within interior section 116 of insulating cylinder 30. An annular gland 124 is provided in extension 122, said annular gland 124 containing ring seal 126, said ring seal 126 co-acting with the extension 122 and interior section 116 to provide fluid sealing contact.

The lower end 128 of extension 122 is inclined upwardly and outwardly. Surface 130 of projection 108 is inclined upwardly. Inclined surface 128 and inclined surface 130 facilitate retention of sealing ring 110 and sealing ring 114 in their respective positions within section 116, segregated by spacer 112.

Referring to FIG. 1, upper insulating barrel 28 is provided with a reduced diameter upward extending projection 132 the external diameter of projection 132 sized to fit within reduced internal diameter section 137 of outer shell 26.

Conductor 32 is contained centrally of insulating barrel 28. Conductor 32 is connected to electrical connector 134 at its upper end. Electrical connector 134 is a commercially available electrical connector and is equivalent in size and structure to electrical connector 90 previously described herein. The external threading 158 of outer shell 26 is sized and constructed so as to readily connect to wireline rope socket (not shown) provided on an upwardly-extending wireline.

Conductor 32 is connected at its lower end to electrical connector 136. Electrical connector 136 extends downwardly from connector 32, electrical connector 136 having a threaded upper end received within threading provided in insulating barrel 28.

Ring seal gland 162 is provided in the external radial surface of connector 136. Ring seal 160 is provided interior of ring seal gland 162. Ring seal 160 co-acts with the outer radial surface of connector 136 and the inner surface of upper insulating barrel 28 providing a seal to prevent brine infiltration or outflow.

Electrical connector 136 has at its lower end a reduced diameter cylindrical extension 138, said extension 138 defining shoulder 140. A cylindrical spring 34 abuts shoulder 140 and extends downwardly therefrom, spring 34 being so sized as to fit exterior of reduced diameter section 138. Cylindrical spring 34 extends downwardly to receptacle 36. Receptacle 36 comprises a generally cylindrical member having a reduced diameter upward extension 142. The reduced diameter extension defines shoulder 144. The lower end of spring 34 abuts shoulder 144. Receptacle 36 is provided with an inwardly extending generally conical indentation 146 at its lower end, said indentation 146 being so sized as to receivably engage the conical upper surface of contact 24.

OPERATION OF THE INVENTION

In operation, the male connector assembly 12 of the wireline wet connect 10 of the present invention is connected to downwardly extending wireline (not shown) at the wireline rope socket (not shown) in accordance with standard practice. Such connection provides for electrical connection between conductor rod 18 and the conductor contained within the downwardly extending wireline. Three-finned landing member 48 is supported on shoulders (not shown) provided in a drilling pipe sub-assembly. The apparatus and method of such support are commonly practiced in the industry.

Female connector assembly 14 is likewise connected at its upper end to a wireline rope socket, conductor 32 being electrically connected to the conductor contained in the wireline rope socket.

Upon lowering of the upper wireline containing female connector assembly 14 toward male connector assembly 12, the conical upper surface of contact 24, the relatively small diameter of insulating sleeve 20 and inclined shoulder 41 of projection 40 of insulating sleeve 20 facilitate centering of the male connector assembly 12 within female connector assembly 14. Such alignment is further facilitated by the inclined lower surface of projection 108 and the inclined end 148 of retainer sleeve 96.

Forward advancement of female connector assembly 14 is terminated upon contact of surface 148 of retainer sleeve 96 with flange upper surface 45 of cylindrical body 16, female connector assembly 14 then resting on said flange 44, such flange 44 supported by three-finned landing member 48.

In such connected stage, contact 24, having passed through reduced diameter section 111 of female insulating cylinder 30 and through concentric ring seals 110 and 114 engages receptacle 36 and pushes receptacle 36 upward, spring 34 allowing such upward movement of receptacle 36. Such engagement provides electrical connection between the conductor contained in the upwardly-extending wireline and the conductor contained within the downwardly-extending wireline.

Upon connection of female connecting assembly 14 and male connecting assembly 12, drilling fluid is retained within annular spaces defined by the various members of the wireline wet connect 10. Drilling fluid is contained within the annular space defined by the interior surface of retainer sleeve 96 and the interior surface of lower insulating cylinder 30. Such retained fluid is not a problem with reference to the transmittal of electrical signals through the conductor rods as concentric ring seal 110 and 114 effectively seal the fluid contained upward of said seals 110 and 114 within the annular space above said seals. Even though the fluid may be conductive, the insulating cylinder 30, insulating barrel 28 and insulating sleeve 20, co-acting with ring seal 110 and ring seal 114 effectively eliminate electrical transmission through the drilling fluid to an external receiving or transferring medium and further contain the brine retained therein from contact with the metal outer shell 26.

The present invention has been depicted and described in a preferred embodiment. Numerous variations and details of construction and arrangement of members may be apparent to those skilled in the art, which variations are encompassed within the spirit of the invention and the scope of the claims.

I claim:

1. A connectable and releasable electrical wet connect for transmitting electricity between wirelines within a well drill string comprising:

a male connecting assembly releasably receivable within a female connecting assembly;

said male connecting assembly comprising a generally cylindrical body, a conductor rod contained axially therein and extending therefrom;

rod insulation means provided externally of said conductor rod;

said conductor rod provided with an electrical contact;

said female connecting assembly including an outer shell, shell insulation means interior of said outer shell, and an electrical conductor contained axially interior of said shell insulating means;

an electrical receptacle electrically connected with said electrical conductor;

said conductor rod contact receivable by said receptacle;

said conductor rod including a conductor rod extension extending upwardly beyond said cylindrical body;

the electrical contact at the upper end of said conductor rod extension;

the conductor rod insulation means extending to the said electrical contact;

said outer shell and said outer shell insulating means surrounding said conductor rod extension;

said sealing means comprising at least one pair of concentrically arranged, flexibly connected sealing ring the outer sealing ring in sealing contact with the outer shell insulation and the inner sealing ring in sealing contact with the rod insulation means.

2. A connectable and releasable electrical wet connect for transmitting electricity between wirelines within a well drill string comprising:

a male connecting assembly releasably receivable within a female connecting assembly;

said male connecting assembly including a generally cylindrical body, a conductor rod contained axially therein and extending therefrom;

rod insulation means provided externally of said conductor rod;

said conductor rod provided with electrical contact means;

said female connecting assembly including an outer shell, shell insulation means interior of said outer shell, and an electrical conductor contained axially interior of said shell insulation means;

electrical receptacle means electrically connected with said electrical conductor;

said conductor rod contact receivable by said receptacle;

sealing means sealably engaging said rod insulation means and said shell insulation means;

spring means normally biasing said receptacle toward said contact;

said outer shell having a lower inclined surface engageable with and supported upon an inclined shoulder of said male connector assembly cylindrical body;

said sealing means interior of said shell insulation means below said receptacle;

said rod insulation means including electrically insulating material extending within an annulus defined by the cylindrical body and the conductor rod;

said shell insulation means including electrically insulating material provided adjacent of said outer shell;

the electrical contact at the upper end of said conductor rod;

the conductor rod insulation extending to the said electrical contact;

said female connecting means outer shell and said outer shell insulating means surrounding said conductor rod;

said sealing means providing fluid sealing contact between said rod insulation and said shell insulation;

said sealing means comprising at least one pair of concentrically arranged, flexibly connected sealing rings, the outer sealing ring in sealing contact with the shell insulation and the inner sealing ring in sealing contact with the rod insulation.

3. A connectable and releasable electrical wet connect for transmitting electricity between wirelines within a well drill string comprising:

a male connecting assembly releasably receivable within a female connecting assembly;

said male connecting assembly including a generally cylindrical body, a conductor rod contained axially therein and extending therefrom;

rod insulation means provided externally of said conductor rod;

said conductor rod provided with electrical contact means;

said female connecting assembly including an outer shell, shell insulation means interior of said outer shell, and an electrical conductor contained axially interior of said shell insulation means;

electrical receptacle means electrically connected with said electrical conductor;

said conductor rod contact receivable by said receptacle;

sealing means sealably engaging said rod insulation means and said shell insulation means;

spring means normally biasing said receptacle toward said contact;

said sealing means interior of said shell insulation means below said receptacle;

said rod insulation means including electrically insulating material exterior of said conducting rod and extending within an annulus defined by the cylindrical body and the conductor rod;

said shell insulation means including electrically insulating material adjacent and interior of said outer shell;

said conductor rod including a conductor rod extension extending upwardly beyond said cylindrical body;

the electrical contact at the upper end of said conductor rod;

the conductor rod insulation extending to said electrical contact;

said female connecting means outer shell and said outer shell insulating means surrounding said conductor rod extension;

said sealing means providing fluid sealing contact between said rod insulation and said shell insulation;

said sealing means comprising at least one pair of concentrically arranged, flexibly connected sealing rings, the outer sealing ring in sealing contact with the shell insulation and the inner sealing ring in sealing contact with the rod insulation;

said electrical contact including a generally conically-shaped projection;

said electrical receptacle including a generally conically-shaped indentation;

said projection receivable in said indentation;

the said male connecting assembly including a plurality of exterior inclined surfaces and said female connecting assembly including a plurality of interior inclined surfaces whereby the male connecting assembly is telescopically received within said female connecting assembly.

* * * * *